US011506387B2

(12) United States Patent
Dang et al.

(10) Patent No.: US 11,506,387 B2
(45) Date of Patent: Nov. 22, 2022

(54) LOW-POLLUTION COMBUSTOR AND COMBUSTION CONTROL METHOD THEREFOR

(71) Applicant: AECC COMMERCIAL AIRCRAFT ENGINE CO., LTD., Shanghai (CN)

(72) Inventors: Longfei Dang, Shanghai (CN); Pei He, Shanghai (CN); Wei Chen, Shanghai (CN); Rong Xu, Shanghai (CN); Yajia E, Shanghai (CN); Pan Chen, Shanghai (CN); Mingming Su, Shanghai (CN); Hao Chen, Shanghai (CN)

(73) Assignee: AECC COMMERCIAL AIRCRAFT ENGINE CO., LTD., Shanghai (CN)

( * ) Notice: Subject to any disclaimer, the term of this patent is extended or adjusted under 35 U.S.C. 154(b) by 0 days.

(21) Appl. No.: 17/256,768

(22) PCT Filed: Jun. 28, 2019

(86) PCT No.: PCT/CN2019/093634
§ 371 (c)(1),
(2) Date: Dec. 29, 2020

(87) PCT Pub. No.: WO2020/001606
PCT Pub. Date: Jan. 2, 2020

(65) Prior Publication Data

US 2021/0285641 A1 Sep. 16, 2021

(30) Foreign Application Priority Data

Jun. 29, 2018 (CN) ..... 201810698522.1

(51) Int. Cl.
*F23R 3/30* (2006.01)
*F23R 3/28* (2006.01)
(Continued)

(52) U.S. Cl.
CPC ..... *F23R 3/30* (2013.01); *F23R 3/14* (2013.01); *F23R 3/286* (2013.01); *F23R 3/343* (2013.01); *F23R 3/28* (2013.01)

(58) Field of Classification Search
CPC ..... F23R 3/14; F23R 3/16; F23R 3/28; F23R 3/286; F23R 3/30; F23R 3/343; F23D 2900/11001; F23D 2900/11101
See application file for complete search history.

(56) References Cited

U.S. PATENT DOCUMENTS 3,917,173 A 11/1975 Singh
4,265,615 A 5/1981 Lohmann et al.
(Continued)

FOREIGN PATENT DOCUMENTS

CN 102901127 A 1/2013
CN 103343985 A 10/2013
(Continued)

OTHER PUBLICATIONS

International Search Report dated Sep. 27, 2019 in corresponding International application No. PCT/CN2019/093634; 8 pages.
(Continued)

*Primary Examiner* — William H Rodriguez
(74) *Attorney, Agent, or Firm* — Maier & Maier, PLLC

(57) ABSTRACT

A low-pollution combustor and a combustion control method therefor. The low-pollution combustor includes a combustor head including a primary combustion stage and a precombustion stage, the primary combustion stage including a primary-combustion-stage channel and a primary-combustion-stage swirler disposed in the primary-combustion-stage channel. The primary combustion stage includes a pre-film plate disposed in the primary-combustion-stage channel, and the pre-film plate is radially divided into an outer-layer pre-film plate and an inner-layer pre-film plate.
(Continued)

The positions and injection directions of fuel jet points of the primary combustion stage control fuel of the primary combustion stage to be injected into the primary-combustion-stage channel through primary-combustion-stage fuel jet orifices; and part of the fuel directly forms primary-combustion-stage direct-injection fuel spray, and the other part is hit on the pre-film plate close to an inner side of the primary-combustion-stage channel, or the two parts are respectively hit on the two layers of pre-film plates.

9 Claims, 5 Drawing Sheets

(51) Int. Cl.
*F23R 3/34* (2006.01)
*F23R 3/14* (2006.01)

(56) References Cited

U.S. PATENT DOCUMENTS 5,417,070 A 5/1995 Richardson
6,068,470 A * 5/2000 Zarzalis ..... F23D 11/007 239/403
6,360,776 B1 3/2002 McCormick et al.
10,288,291 B2 * 5/2019 Monahan ..... F23D 14/64
2004/0035386 A1 * 2/2004 Sanders ..... F23R 3/32 123/305
2005/0039456 A1 * 2/2005 Hayashi ..... F23D 11/107 60/737
2007/0028619 A1 * 2/2007 Spooner ..... F23D 11/386 60/737
2007/0289306 A1 * 12/2007 Suria ..... F23R 3/14 60/748
2009/0173076 A1 * 7/2009 Toon ..... F23D 14/74 60/746
2010/0050644 A1 * 3/2010 Pidcock ..... F23R 3/343 60/737
2011/0271681 A1 11/2011 Bagchi et al.
2015/0089920 A1 * 4/2015 Ford ..... F23R 3/14 60/39.48
2015/0159874 A1 * 6/2015 Toon ..... F23D 11/107 60/737
2016/0084503 A1 3/2016 Hawie et al.
2017/0122211 A1 * 5/2017 Zhang ..... F02C 7/222
2017/0130652 A1 * 5/2017 Siders ..... F23R 3/14
2017/0184309 A1 * 6/2017 Turrini ..... F23R 3/286
2017/0191457 A1 7/2017 Spivey et al.
2019/0170354 A1 * 6/2019 Resvanis ..... F23R 3/14
2020/0025386 A1 * 1/2020 Muldal ..... F23R 3/14
2021/0172604 A1 * 6/2021 Locke ..... F23R 3/14

FOREIGN PATENT DOCUMENTS

CN 204006123 U 12/2014
CN 104329689 A 2/2015
CN 104406196 A 3/2015
CN 104456627 A 3/2015
CN 103343985 B 7/2015
CN 105180215 A 12/2015
CN 105180251 A 12/2015
CN 205299615 U 6/2016
CN 106091013 A 11/2016
EP 1 096 206 B1 8/2006

OTHER PUBLICATIONS

Chinese Search Report dated May 20, 2020, in connection with corresponding CN Application No. 201810698522.1 (4 pp., including partial machine-generated English translation).
Supplemental European Search Report dated Mar. 14, 2022, in connection with corresponding European Application No. 19825231.4; 9 pages.

* cited by examiner

LOW-POLLUTION COMBUSTOR AND COMBUSTION CONTROL METHOD THEREFOR

FIELD

The present invention relates to an aero-gas turbine combustor and a combustion control method.

BACKGROUND

The main development trend of modern civil aero-engine combustors is low-pollution combustion. The civil aero-engine combustors must meet the increasingly stringent aero-engine pollutant emission standards. The currently adopted CAEP6 (Committee on Aviation Environmental Protection) standard has very strict regulations on pollutant emissions, especially on NOx. However, the latest CAEP8 standard proposes to reduce NOx emissions by 15% on the CAEP6 emission standard. With the rapid development of the aviation industry and the continuous improvement of people's awareness of environmental protection, higher requirements will put forward on the pollutant emissions of gas turbine combustors in the future. In order to meet the increasingly stringent pollutant emission standards, advanced low-pollution combustion technologies have been gradually applied to the design of civil aero-engine combustors, such as LPP (Lean Premixed Prevaporized) combustion technology, RQL (Rich burn-Quench-Lean burn) combustion technology, and staged combustion technology, and LDI (Lean Direct Injection) combustion technology. The LPP low-pollution combustion technology is a low-pollution combustion technology with good development prospect at present, and as shown in the disclosed data, the test values of the combustor pollutant emissions thereof can be reduced by 50% or more compared with the CAEP6 standard, reflecting good low-pollution combustion performance. The head of an advanced LPP low-pollution combustor (such as a TAPS combustor) usually uses a LPP and staged combustion coupled design, that is, in which a precombustion stage provides, at the center, a flame that is partially premixed and partially diffused, and a primary combustion stage surrounds the periphery of the precombustion stage and is concentrically arranged with the precombustion stage to form a premixing and prevaporization channel, such that by means of the multi-point fuel injection by the primary combustion stage, fuel and air are premixed and prevaporized in a primary-combustion-stage channel, enter a flame tube combustion zone, and are ignited by a precombustion stage flame. Because under high-power conditions, most of the fuel is provided by a nozzle of the primary combustion stage, and the primary combustion stage is in a lean premixed prevaporized combustion mode, this combustion organization mode can reduce the temperature of fuel gas in the combustion zone so as to reduce the production of NOx.

The core problem of the LPP low-pollution combustion technology is to reduce the temperature in the combustion zone while achieving the uniform temperature field in the combustion zone, that is, the problem of overall and local equivalence ratio control. The primary combustion stage at the head of the LPP low-pollution combustor mostly uses a mixed mode in which swirling air and multi-point radial fuel direct injection (usually Jet in Crossflow) for premixing and prevaporization of fuel. Under different engine operating conditions, due to the change of air inflow of a swirler and the change of the intensity of turbulence of swirling air, it is possible to cause inconsistent degree of premixing and prevaporization under different operating conditions, resulting in backfire of the primary combustion stage (under large operating conditions, the fuel injection has high momentum, the initial fuel atomization is good, the air swirling effect is strong, and the degree of premixing and prevaporization is very good), or there are large-particle unvaporized fuel at an outlet of the primary combustion stage (under small operating conditions, the fuel injection has small momentum, the intensity of turbulence of air is low, the fuel atomization is poor, and the degree of premixing and prevaporization is very poor), and the equivalence ratio is not uniform, causing the problems of reduced combustion efficiency, hot spots in the combustion zone, increased NOx emissions at the outlet of the combustor, etc.

SUMMARY

An object of the present invention is to provide a low-pollution combustor, which allows a combustible mixed gas to be distributed more uniformly in a flame tube under different operating conditions.

Another object of the present invention is to provide a low-pollution combustor and a combustion control method therefor, which ensure the combustion efficiency and combustion stability under different operating conditions, and control the combustion temperature in a primary combustion zone to reduce pollutant emissions of the combustor.

A low-pollution combustor, comprising a combustor head which comprises a primary combustion stage and a precombustion stage, the primary combustion stage comprising a primary-combustion-stage channel and a primary-combustion-stage swirler disposed in the primary-combustion-stage channel, wherein the primary combustion stage further comprises a pre-film plate disposed in the primary-combustion-stage channel, and the pre-film plate is radially divided into an outer-layer pre-film plate and an inner-layer pre-film plate, and wherein the positions of fuel jet points and the injection direction of the primary combustion stage are configured to control fuel of the primary combustion stage to be injected into the primary-combustion-stage channel through primary-combustion-stage fuel jet orifices; and part of the fuel directly forms primary-combustion-stage direct-injection fuel spray, and the other part is hit on the pre-film plate close to an inner side of the primary-combustion-stage channel, or the two parts are respectively hit on the two layers of pre-film plates.

In an implementation of the low-pollution combustor, the primary combustion stage has the number of stages of $1 \leq n \leq 2$, and each of the stages uses an axial, radial or oblique swirler; and when $n \geq 2$, all the swirlers have the same or opposite swirling directions.

In an implementation of the low-pollution combustor, the primary-combustion-stage channel has a channel that contracts and then expands.

In an implementation of the low-pollution combustor, the pre-film plates and the combustor head are concentric and in a ring shape, both the pre-film plates have the cross section of a streamlined structure, the inner-layer pre-film plate is located at the downstream of the outer-layer pre-film plate in the head central axial direction of the combustor head, and the two layers of pre-film plates have different radial heights and are located at 20% to 80% of the radial height of the primary-combustion-stage channel.

In an implementation of the low-pollution combustor, the primary combustion stage comprises a primary-combustion-stage fuel collection ring, which has one row of fuel jet points in the axial direction of the head, the fuel jet points include first jet points and second jet points with different injection directions, and the first jet points and the second jet points are uniformly and alternately distributed in a circumferential direction, with an included angle formed by the fuel injection direction of the first jet point and the head central axial direction being 60° to 90° such that fuel is hit on a wall surface of an inner side of the outer-layer pre-film plate, and with an included angle formed by the fuel injection direction of the second jet point and the head central axial direction being 30° to 50° such that the fuel is hit on a wall surface of an inner side of the inner-layer pre-film plate.

In an implementation of the low-pollution combustor, the first jet points and the second jet points are alternately arranged in the axial direction in a manner of 1a1b, 1a2b, 2a1b, 3a1b or 1a3b, a being the first jet point, and b being the second jet point, and values of flow of the first jet points and the second jet points have different design values to ensure respective sufficient penetration depths thereof.

In an implementation of the low-pollution combustor, the primary combustion stage comprises the primary-combustion-stage fuel collection ring which is provided with multiple rows of circumferentially and uniformly distributed fuel jet points in the axial direction of the head, with some rows of the fuel jet points being aligned with the inner-layer pre-film plate, and the other rows of the fuel jet points being aligned with the outer-layer pre-film plate.

In an implementation of the low-pollution combustor, the primary combustion stage and the precombustion stage are concentrically arranged, the fuel of the primary combustion stage accounts for 50% to 92% of the total quantity of fuel, and the volume of air in the combustor head accounts for 60% to 90% of the total volume of air in the combustor, with the volume of air at the primary combustion stage accounting for 60% to 90% of the volume of air in the head, and the volume of air at the precombustion stage accounting for 10% to 40% of the volume of air in the head.

In an implementation of the low-pollution combustor, the swirler of the precombustion stage has the number of stages of $1 \leq n \leq 3$; the swirler structure used for each stage of swirler is an axial swirler, a radial swirler or an oblique swirler; the swirlers at all stages are firstly connected as a whole and then connected to the primary combustion stage; and when $n \geq 2$, all the swirlers have the same swirling directions, or some have opposite swirling directions.

A low-pollution combustion control method for a combustor, the method comprising: providing, in a primary-combustion-stage channel, an inner-layer pre-film plate and an outer-layer pre-film plate which are distributed in a radial direction; injecting primary-combustion-stage fuel out through primary-combustion-stage fuel jet orifices, wherein under small operating conditions, the primary-combustion-stage fuel has a small penetration depth and is mainly hit on the inner-layer pre-film plate of the primary-combustion-stage channel, or under large operating conditions, the primary-combustion-stage fuel is respectively hit on the inner-layer pre-film plate and the outer-layer pre-film plate of the primary-combustion-stage channel, and the fuel is hit on the pre-film plates to form liquid films; and further providing a primary-combustion-stage swirling flow, breaking and atomizing the liquid films under a shearing action of the swirling flow to form small-particle fuel spray, and mixing the fuel spray with air such that a uniformly distributed fuel-air mixture, with the center of concentration gradually moving outward from small to large, is formed in a radial direction of a primary-combustion-stage outlet and then enters a flame tube for premixed combustion.

The primary-combustion-stage fuel is injected out through the primary-combustion-stage fuel jet orifices. Under small operating conditions, the primary-combustion-stage fuel has a small penetration depth and is mainly hit on the pre-film plate close to the inner side of the primary-combustion-stage channel, and under large operating conditions, the primary-combustion-stage fuel is respectively hit on the two pre-film plates. The fuel is hit on the two primary-combustion-stage pre-film plates to form the liquid films, and is further broken and atomized under the shearing action of the primary-combustion-stage swirling flow to form the small-particle fuel spray. The two streams of fuel spray are mixed with air such that a uniformly distributed fuel-air mixture, with the center of concentration gradually moving outward from small to large, is formed in a radial direction of a primary-combustion-stage outlet and then enters a flame tube for premixed combustion. As such, the combustible mixed gas is distributed in the flame tube more uniformly to ensure the combustion efficiency and combustion stability under different operating conditions, and the combustion temperature in a primary combustion zone is controlled so as to reduce pollutant emissions of the combustor.

BRIEF DESCRIPTION OF THE DRAWINGS

The above and other features, properties and advantages of the present invention will become more apparent from the following description of embodiments with reference to the accompany drawings, in which.

DETAILED DESCRIPTION

Figure 1:
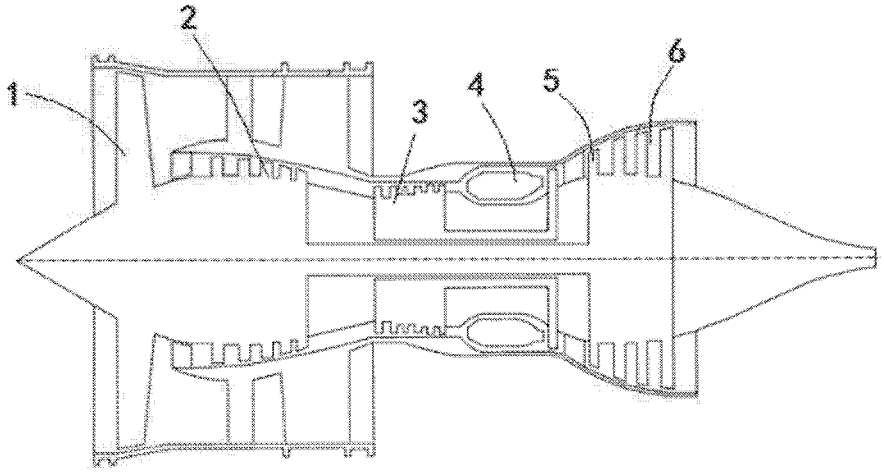
FIG. 1 is a schematic diagram of an aero-engine.

Various implementations or embodiments carrying out the subject matter and technical solutions described are disclosed as follows. To simplify the disclosure, specific instances of each element and arrangement are described below. Of course, these instances are merely examples, and are not intended to limit the scope of protection of the present invention. For example, a first feature recorded later in the specification being formed above or over a second feature can include an implementation of forming a direct contact of the first and second features, and can also include an implementation of forming an additional feature between the first feature and the second feature such that the first and second features may not be in direct contact. Additionally, reference numerals and/or letters may be repeated in different examples in these disclosures. This repetition is for the sake of brevity and clarity, and does not itself represent the relationship between the various implementations and/or structures to be discussed. Further, when a first element is described in connection with or in combination with a second element, the description includes an implementation in which the first and second elements are directly connected or combined to each other, and also includes the use of one or more other intervening elements such that the first and second elements are indirectly connected or combined to each other.

FIG. 1 is a schematic structural diagram of an engine. The engine comprises a fan 1, a low-pressure compressor 2, a high-pressure compressor 3, a combustor 4, a high-pressure turbine 5, and a low-pressure turbine 6. When the engine operates, air is compressed by the fan 1 and the low-pressure compressor 2 and then enters the high-pressure compressor 3, then the high-pressure air enters the combustor 4 and is mixed with fuel for combustion, and the high-temperature and high-pressure gas generated after combustion enters the high-pressure turbine 5 and the low-pressure turbine 6, and applies work through the turbines to respectively drive the high-pressure compressor 3, the low-pressure compressor 2 and the fan 1.

Figure 2:
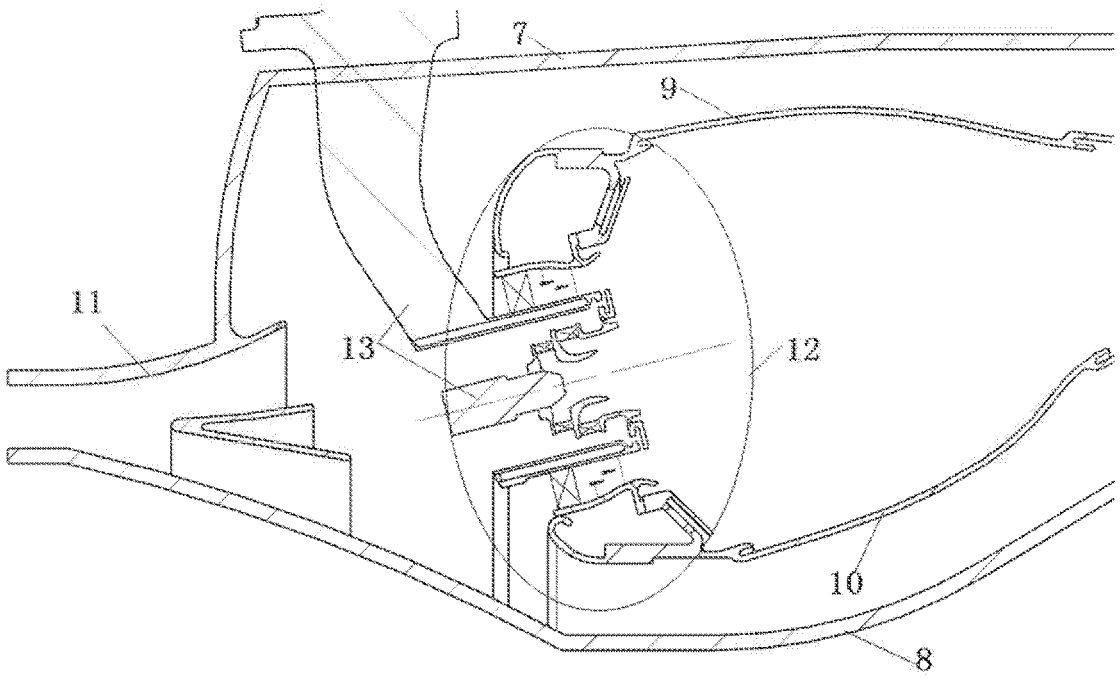
FIG. 2 is a cross-sectional view of a combustor.

As shown in FIG. 2, the combustor 4 uses a single annular cavity structure, and a combustor outer casing 7 and a combustor inner casing 8 form an outer profile of the combustor and are connected with the high-pressure compressor 3 in the front and the high-pressure turbine 5 in the rear. Incoming air of the high-pressure compressor 3 enters the combustor 4 from a diffuser 11 after speed reduction and diffusion, and is combusted with fuel in a space enclosed by a flame-tube outer wall 9, a flame-tube inner wall 10 and combustor heads 12. All the fuel in the combustor is provided by a fuel injection rod assembly 13.

Figure 3:
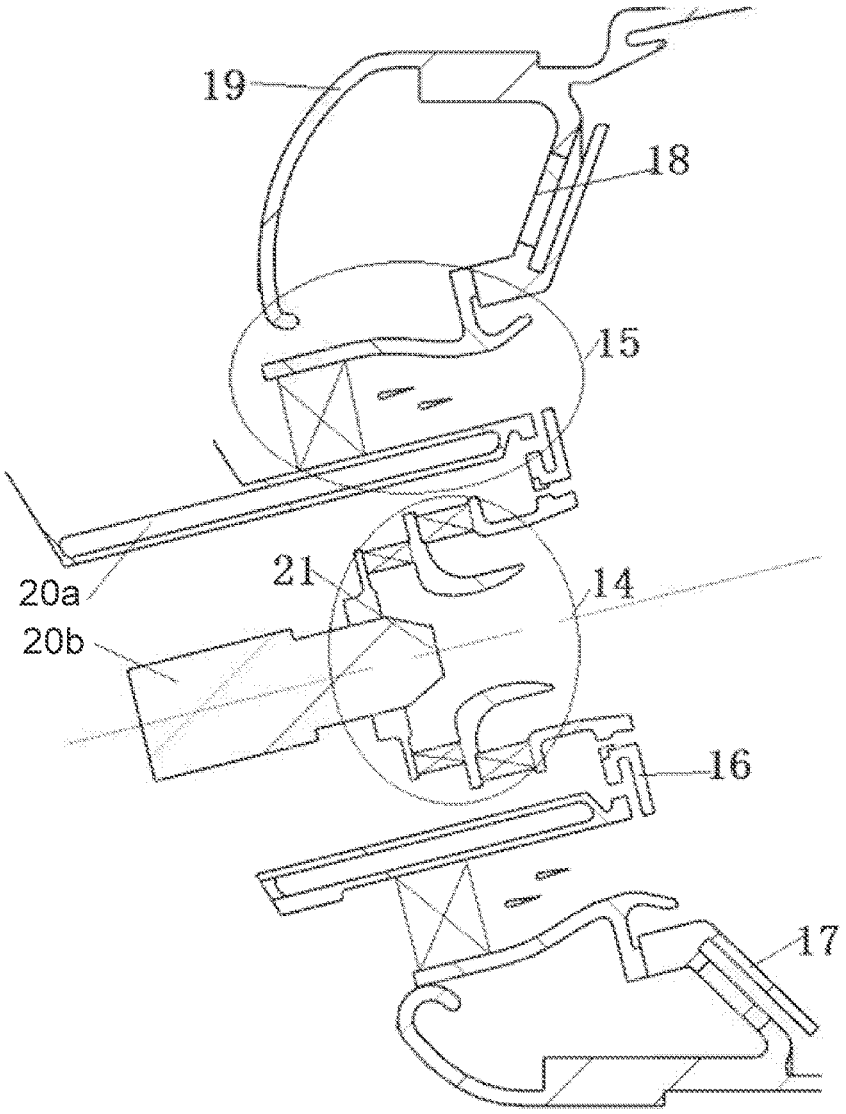
FIG. 3 is a cross-sectional view of a combustor head.

FIG. 3 is a cross-sectional view of the structure of a combustor head 12. The combustor head 12 comprises a precombustion stage 14, a primary combustion stage 15, and main structures such as a fuel collection ring and a centrifugal nozzle housing 13. In one implementation, a fuel nozzle supplies all the fuel required by the combustor, and the fuel in the primary stage 15 accounts for 50% to 92% of the total quantity of fuel. The primary combustion stage 15 and the precombustion stage 14 are arranged together in a concentric manner, with the precombustion stage 14 being in the center, and the primary combustion stage 15 being arranged at the periphery of the precombustion stage 14. The combustor heads 12 are uniformly arranged in a circumferential direction, and in one implementation, the number of the combustor heads is 10 to 60, and the volume of air of the combustor heads accounts for 20% to 80% of the total volume of air of the combustor, with the volume of air of the primary combustion stage 15 accounting for 60% to 90% of the volume of air of the heads, and the volume of air of the precombustion stage 14 accounting for 10% to 40% of the volume of air of the heads. The primary combustion stage 15 is connected and fixed, by means of bolts, to the flame-tube outer wall 9, the flame-tube inner wall 10 and head caps 19 through a head integral end wall 18 and a splash plate 17, the precombustion stage 14 is fixedly connected to the primary combustion stage 15 through an interstage splash plate structure 16, and a primary-combustion-stage fuel collection ring 20*a* and a precombustion stage nozzle fuel collecting cavity 20*b* supply all the fuel in the combustor 4. The head splash plate 17 is welded to the head integral end wall 18, such that they are separated from the high-temperature gas in the flame tube so as to ensure the structural integrity.

Figure 4:
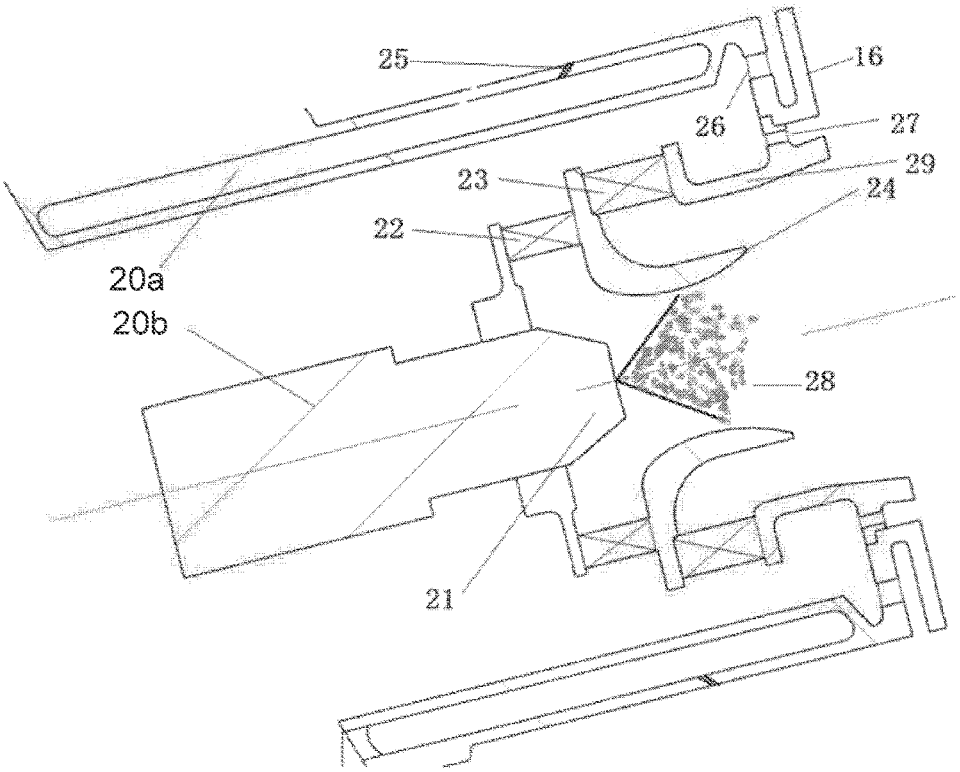
FIG. 4 is a cross-sectional view of a precombustion stage.

In FIG. 4, the precombustion stage 14 uses a double-swirler structure composed of a precombustion-stage first-stage swirler 22, a precombustion-stage second-stage swirler 23, a precombustion-stage swirler venturi tube 24, a precombustion-stage sleeve 29 and an interstage splash plate structure 16, which are welded together. Precombustion-stage fuel spray 28 is subjected to pre-film stage air atomization using the precombustion-stage swirler venturi tube 24. The number of the precombustion stages 14 is not limited to two, and in one embodiment, the number of stages of the swirlers is $1 \leq n \leq 3$; the swirler structure used for each stage of swirler is an axial swirler, a radial swirler or an oblique swirler; the swirlers at all stages are firstly connected as a whole and then connected to the head end wall of the primary combustion stage; and when $n \geq 2$, all the swirlers may have the same swirling directions, or some may have opposite swirling directions. A pressure atomizing nozzle, a pneumatic atomizing nozzle or a combined nozzle is provided at a precombustion-stage fuel jet point 21.

Figure 5:
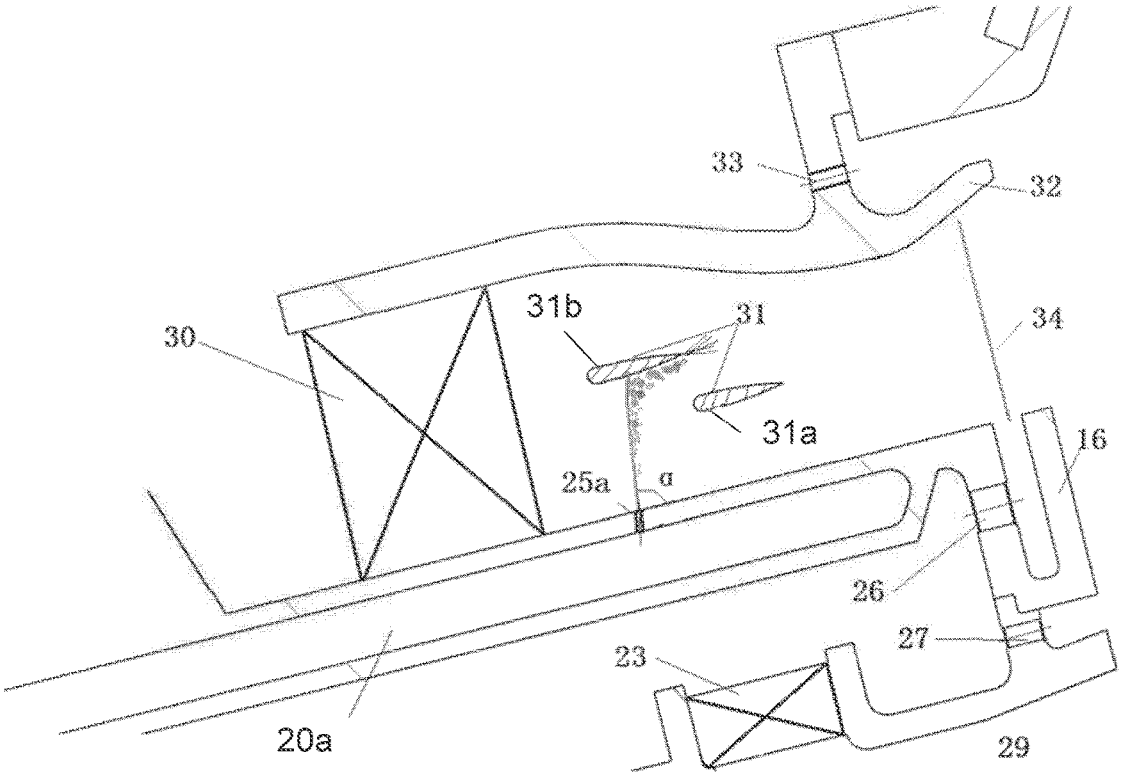
FIG. 5 is a cross-sectional view of an embodiment of a primary combustion stage.

As shown in FIG. 5, the primary combustion stage 15 comprises a primary-combustion-stage swirler 30, a pre-film plate 31, a primary-combustion-stage channel outer wall surface 32, and a primary-combustion-stage outer channel cooling structure hole 33. The primary-combustion-stage fuel collection ring 20*a* is circumferentially provided with a primary-combustion-stage jet orifice 25 to provide premixed prevaporized fuel. In conjunction with FIG. 5, air 34 provided through a hole 26 in the interstage splash plate structure 16 facilitates increasing the opening angle of a primary-combustion-stage gas flow outlet, and the air 34 flows from an annular groove in the interstage splash plate structure 16 to an outlet of the primary-combustion-stage channel, thereby ensuring the radial dimension of a return flow zone.

Figure 6:
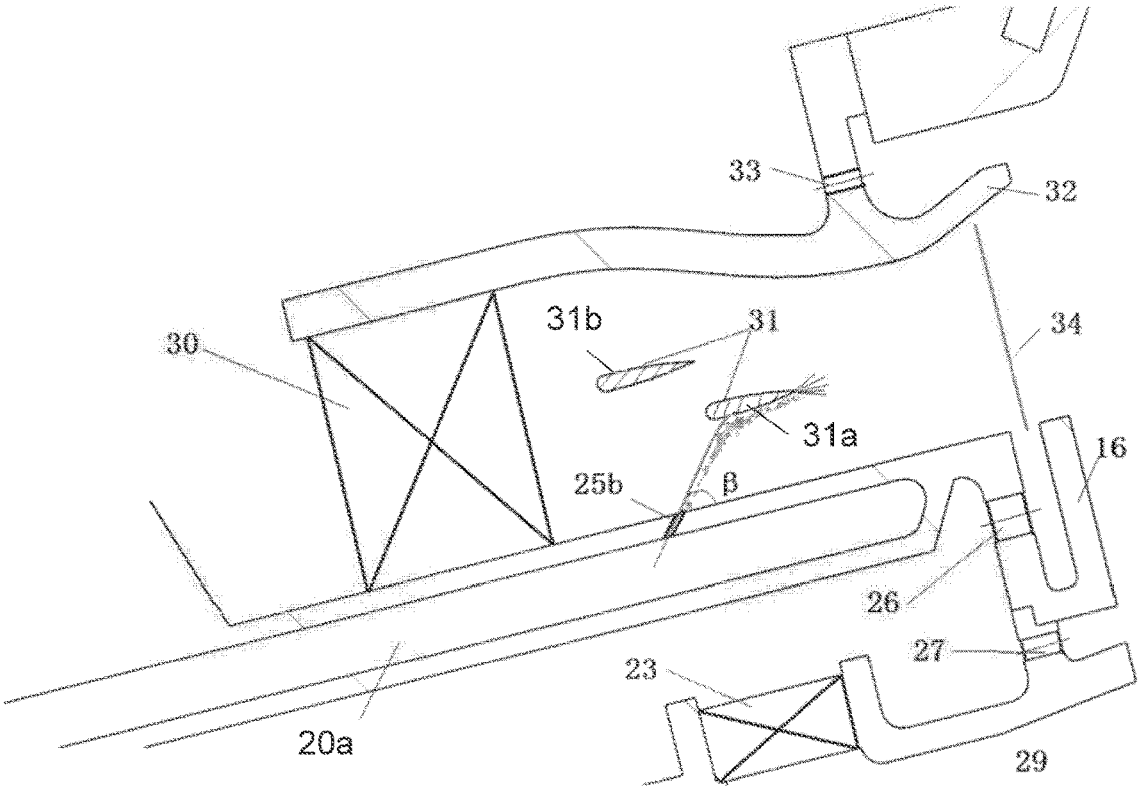
FIG. 6 is a cross-sectional view of another embodiment of the primary combustion stage.

As shown in FIGS. 5 and 6, the primary-combustion-stage jet points 25 may be designed as a single row in the flow direction of the head, and jet orifices 25*a*, 25*b* having two fuel injection angles $\alpha$, $\beta$ are alternately uniformly distributed in the circumferential direction. The fuel is hit on the two layers of pre-film plates to form liquid films and is broken and atomized under the shearing action of a primary-combustion-stage swirling flow, improving the uniform distribution of the fuel-gas mixture in the radial and circumferential directions at the outlet of the primary-combustion-stage channel; and in one implementation, the number of the single-row fuel jet points is 12 to 60. The fuel jet point with the fuel injection angle $\alpha$ is set as a, the fuel jet point with the fuel injection angle $\beta$ is set as b, and the two types of jet points are uniformly distributed in the circumferential direction in an alternate manner of 1a1b, 1a2b, 2a1b, 3a1b or 1a3b. Taking the 1a1b as an example, one fuel jet point with the injection angle $\alpha$ alternates with one fuel jet point with the injection angle $\beta$. Taking 1a2b as an example, one fuel jet point with the injection angle $\alpha$ alternates with two fuel jet points with the injection angles $\beta$.

a represents an included angle formed by the fuel injection direction of the jet point and the head central axial direction, and is 60° to 90° in one implementation, designed in such a way that the fuel is hit on the inner-side wall surface of the outer-layer pre-film plate. $\beta$ represents an included angle of 30° to 50° formed by the fuel injection direction of the jet point and the head central axial direction, designed in such a way that the fuel is hit on the inner-side wall surface of the inner-layer pre-film plate. Values of flow of the jet points a and the jet points b may have different design values to ensure respective sufficient penetration depths thereof.

In another embodiment, although not shown in the figure, it should be understood that two types of fuel jet orifices are designed in double rows in the flow direction at the head and are uniformly distributed in the circumferential direction, that is, the fuel jet orifices are arranged in rows at different positions in the axial direction, respectively aligned with the outer-layer pre-film plate 31*b* and the inner-layer 31*a* as shown in FIG. 5.

The number of the primary combustion stages is not limited to one, and in one implementation, the number of the precombustion stages is $1 \leq n \leq 2$, and each stage uses an axial, radial or oblique swirler; and when $n \geq 2$, all the swirlers may have the same or opposite swirling directions. As shown in FIG. 5, the primary combustion stage has a primary-combustion-stage channel that first contracts and then expands so as to enhance the premixing of fuel and air in the primary-combustion-stage channel while guiding the gas flow at the primary-combustion-stage outlet to expand, thereby ensuring the ignition performance of the head.

As shown in FIG. 5, the pre-film plate 31 includes the inner-layer pre-film plate 31*a* and the outer-layer pre-film plate 31*b* layered in the radial direction, and the two pre-film plates have different radial heights and are respectively located at 20% to 80% of the radial height of the primary-combustion-stage channel (also referred to as the primary-combustion-stage air channel). As shown in FIG. 5, the inner-layer pre-film plate 31*a* is located at the downstream of the outer-layer pre-film plate 31*b*. Under small operating conditions, the fuel partially forms primary-combustion-stage direct-injection fuel spray, and the primary-combustion-stage fuel has small penetration depth, and is mainly hit on the inner-layer pre-film plate 31*a* close to the inner side of the primary-combustion-stage channel. Under large operating conditions, the primary-combustion-stage fuel is injected into a primary-combustion-stage air channel through the primary-combustion-stage fuel jet orifice 25*a* or 25*b*, and part of the fuel forms primary-combustion-stage direct-injection fuel spray, and the other part is hit on the pre-film plate 31, that is, simultaneously hit on the inner-layer pre-film plate 31*a* and the outer-layer pre-film plate 31*b*, to form liquid films and are broken and atomized under the shearing action of primary-combustion-stage swirling air to form primary-combustion-stage pneumatically atomized fuel spray, and the two streams of fuel spray are mixed with air to form a relatively uniform fuel-air mixture. Under large operating conditions, the fuel is hit on the two primary-combustion-stage pre-film plates to form the liquid films, and is further broken and atomized under the shearing action of the primary-combustion-stage swirling flow to form the small-particle fuel spray. The two streams of fuel spray are mixed with air such that a uniformly distributed fuel-air mixture, with the center of concentration gradually moving outward from small to large, is formed in a radial direction of a primary-combustion-stage outlet and then enters a flame tube for premixed combustion.

Figure 7:
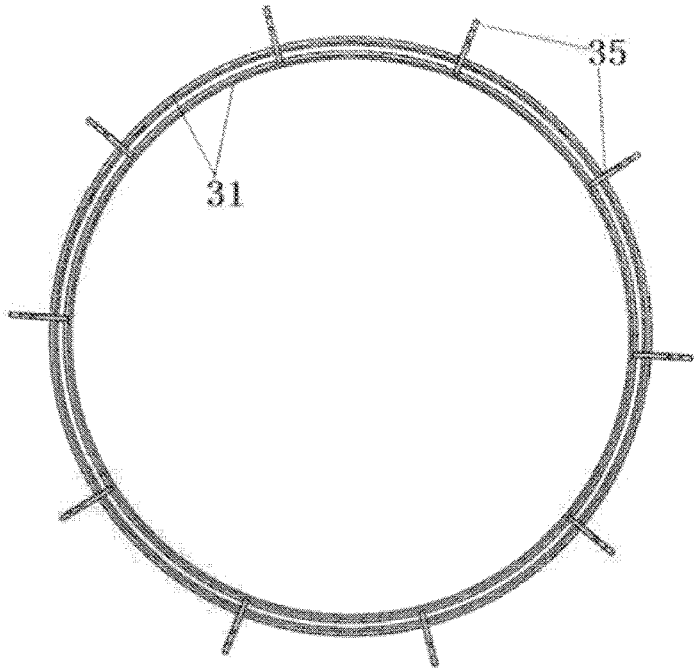
FIG. 7 is a transverse cross-sectional view of two layers of pre-film plates.
Figure 8:
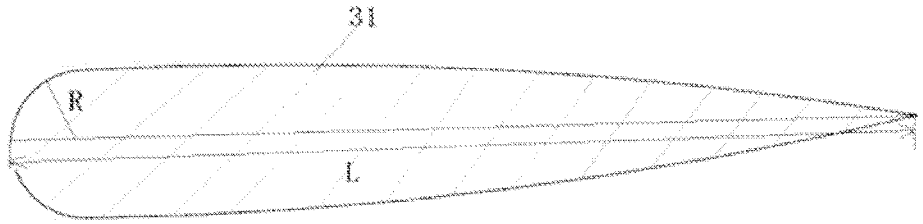
FIG. 8 is a longitudinal cross-sectional view of any one of the pre-film plates.

As shown in FIGS. 6 and 7, the pre-film plate 31 is welded to the outer wall surface 32 of the primary-combustion-stage channel via supporting plates 35 thereof. The supporting plates 35 are uniformly distributed in the circumferential direction, and has the number of 8 to 20. As shown in FIG. 8, the pre-film plate 31 uses a symmetrical leaf-shaped design, and by means of adjusting the chord length L and the maximum leaf thickness R of the pre-film plate, the pre-film atomization degree of the primary-combustion-stage fuel and the interaction degree of the fuel spray and air are further improved.

In one implementation, the flame tube outer wall 9 and the flame tube inner wall 10 of the combustor are cooled by means of gas film cooling, diffusion cooling or combined cooling so as to control the temperature of wall surfaces to prolong the service life of the flame tube.

In the forgoing implementations, all the air for combustion enters the flame tube from the combustor heads, such that most of the fuel is uniformly mixed with air and then enters the flame tube for combustion, which is conducive to controlling the equivalence ratio in the combustion zone to reduce pollutant emissions. A central staged structure and a staged combustion scheme is used. When the precombustion stage is in the center, it is a method of diffusion combustion combined with swirling-flow premixed combustion to ensure the combustion stability of the whole combustor. When the primary combustion stage is at the periphery of the precombustion stage, it is a premixed combustion method, in which liquid fuel is atomized and vaporized in the premixing and prevaporization section and is mixed with air to form uniform combustible mixed gas which enters the combustor to participate in combustion. Compared with the prior art, the forgoing implementations have the following advantages:

(1) in the primary combustion stage, jet orifices uniformly distributed in the circumferential direction are used to directly inject fuel, the radially arranged two layers of pre-film plates improve the uniform distribution of the fuel spray in the circumferential and radial directions in the primary-combustion-stage channel, and the swirling flow of the swirler has a strong shearing effect on the fuel films and fuel spray, such that by means of combined adjustment for the swirling direction and the strength of swirling flow to adjust the premixing degree of fuel in the primary-combustion-stage channel, it is possible to achieve more uniform fuel diffusion and fuel-air mixing, and better prevaporization effect; and with the increase of operating conditions, the center of the fuel-air mixture at the outlet of the primary-combustion-stage channel gradually radially moves outward (adjustment of concentration distribution), such that the combustible mixed gas is distributed in the flame tube more uniformly to ensure the combustion efficiency and combustion stability under different operating conditions, and the combustion temperature in a primary combustion zone is controlled so as to reduce pollutant emissions of the combustor;

(2) the primary-combustion-stage fuel nozzles provide multi-point uniformly distributed direct injection in the circumferential direction, and the positions and injection directions of the jet points are designed to control the uniform direction of fuel in the radial and circumferential directions in the primary-combustion-stage channel, which is conductive to reducing pollutant emissions;

(3) the premixing and prevaporization section of the primary combustion stage uses a jet tube structure, in which the gas flow in the contraction section is accelerated, which is conductive to the air atomization and fuel-air mixing of the fuel; the expansion section ensures that the return flow zone is not compressed, in the radial dimension, by the primary combustion stage gas flow, which is conductive to the ignition characteristics; and the primary combustion stage has a simple structure and is easy to assemble;

(4) with the single annular cavity combustor structure, all the air for combustion is supplied by the head, and the flame tube only has necessary cooling holes and thus has a modular feature, simplifying the combustor structure, and the premixing and prevaporization round tube has a simple structure and is easy to machine;

(5) based on the staged combustion concept, the precombustion stage provides a stable fire source, and the primary combustion stage realizes low-pollution combustion, thereby ensuring the stability of the combustor of the aero-engine while reducing pollutant emissions; and the purpose of reducing pollutant emissions is also achieved by means of controlling the equivalence ratio of the combustion zone in the aero-engine combustor and the variation and uniformity of the fuel-air mixture in the radial and circumferential directions at the primary-combustion-stage outlet.

The forgoing implementations can be used for civil aero-engine combustors, and based on the central staged and lean premixed prevaporized combustion technologies, it is possible to ensure the stability of the aero-engine combustor while reducing pollutant emissions.

With the structure of the primary combustion stage designed according to the forgoing implementations, it is possible to achieve better premixing and prevaporization effect of the primary-combustion-stage fuel and the primary combustion stage air; the premixing degree of the premixing and prevaporization section of the primary combustion stage can be changed by means of adjusting the air flow and the swirling flow number of the swirler of the primary combustion stage; the design of the shape and position of the pre-film plates can improve the mixing degree of fuel and air in the primary-combustion-stage channel and the degree of uniform distribution of the combustible mixed gas in the circumferential and radial directions at the primary-combustion-stage channel outlet; with the increase of operating conditions, the center of the fuel spray at the primary-combustion-stage outlet gradually radially moves outward, so as to ensure the combustion efficiency and the combustion stability under different operating conditions; based on the rational design of the positions and injection directions of the primary-combustion-stage fuel jet orifices, the uniform distribution of the fuel in the circumferential direction in the primary-combustion-stage channel is improved; and based on the design of the jet tube structure of the premixing and prevaporization section of the primary combustion stage, under the combined action of the design of the outlet section flow channel and the pneumatically guided radial air at the outlet of the primary combustion stage, the size of the return flow zone of the primary combustion zone in the flame tube can be controlled, which is conductive to improving the flame stability in ignition and transition states. Therefore, the forgoing implementations are conductive to optimizing the combustion organization structure, improving the combustion performance and the combustion efficiency, and reducing the pollutant emissions and fuel consumption rate of the engine.

The present invention has been disclosed above in terms of the preferred embodiments which, however, are not intended to limit the present invention, and any person skilled in the art could make possible changes and alterations without departing from the spirit and scope of the present invention. Hence, any alterations, equivalent changes and modifications which are made to the above-mentioned embodiments in accordance with the technical substance of the present invention and without departing from the content of the technical solutions of the present invention, will fall within the scope of protection defined by the claims of the present invention.

The invention claimed is:

1. A low-pollution combustor, comprising:

a combustor head which includes a primary combustion stage and a precombustion stage, the primary combustion stage including a primary-combustion-stage channel and a primary-combustion-stage swirler disposed in the primary-combustion-stage channel;

wherein the primary combustion stage further includes a pre-film plate disposed in the primary-combustion-stage channel, and the pre-film plate is radially divided into an outer-layer pre-film plate and an inner-layer pre-film plate;

wherein the positions and injection directions of fuel jet points of the primary combustion stage are configured to control fuel of the primary combustion stage to be injected into the primary-combustion-stage channel through primary-combustion-stage fuel jet orifices, a part of the fuel directly forms primary-combustion-stage direct-injection fuel spray, and an other part of the fuel is hit on the pre-film plate close to an inner side of the primary-combustion-stage channel, or the two parts are respectively hit on the two layers of pre-film plates; and wherein the primary combustion stage and the precombustion stage are concentrically arranged, the fuel of the primary combustion stage accounts for 50% to 92% of the total quantity of fuel, and the volume of air in the combustor head accounts for 60% to 90% of the total volume of air in the combustor, with the volume of air at the primary combustion stage accounting for 60% to 90% of the volume of air in the combustor head, and the volume of air at the precombustion stage accounting for 10% to 40% of the volume of air in the combustor head.

2. The low-pollution combustor of claim 1, further comprising a plurality of primary combustion stages, a number of the primary combustion stages being represented by n; wherein, when n is in the range of $1 \leq n \leq 2$, each of the stages uses an axial, radial or oblique swirler; and when $n \geq 2$, all the swirlers have the same or opposite swirling directions.

3. The low-pollution combustor of claim 1, wherein the primary-combustion-stage channel has a channel that contracts and then expands.

4. The low-pollution combustor of claim 1, wherein the pre-film plates and the combustor head are concentric and in a ring shape, both the pre-film plates have the cross section of a streamlined structure, the inner-layer pre-film plate is located at the downstream of the outer-layer pre-film plate in the head central axial direction of the combustor head, and the two layers of pre-film plates have different radial heights and are located at 20% to 80% of the radial height of the primary-combustion-stage channel.

5. The low-pollution combustor of claim 1, wherein the primary combustion stage includes a primary-combustion-stage fuel collection ring, which has one row of fuel jet points in the axial direction of the head, the fuel jet points include first jet points and second jet points with different injection directions, and the first jet points and the second jet points are uniformly and alternately distributed in a circumferential direction, with an included angle formed by the fuel injection direction of the first jet point and the head central axial direction being 60° to 90° such that fuel is hit on a wall surface of an inner side of the outer-layer pre-film plate, and with an included angle formed by the fuel injection direction of the second jet point and the head central axial direction being 30° to 50° such that the fuel is hit on a wall surface of an inner side of the inner-layer pre-film plate.

6. The low-pollution combustor of claim 5, wherein the first jet points and the second jet points are alternately arranged in the axial direction in a manner of 1a1b, 1a2b, 2a1b, 3a1b or 1a3b, a being the first jet point, and b being the second jet point, and values of flow of the first jet points and the second jet points have different design values to ensure respective sufficient penetration depths thereof.

7. The low-pollution combustor of claim 1, wherein the swirler of the precombustion stage has the number of stages of $1 \leq n \leq 3$; the swirler structure used for each stage of swirler is an axial swirler, a radial swirler or an oblique swirler; the swirlers at all stages are firstly connected as a whole and then connected to the primary combustion stage; and when n≥2, all the swirlers have the same swirling directions, or some have opposite swirling directions.

8. A low-pollution combustor, comprising:

a combustor head which includes a primary combustion stage and a precombustion stage, the primary combustion stage including a primary-combustion-stage channel and a primary-combustion-stage swirler disposed in the primary-combustion-stage channel;

wherein the primary combustion stage further includes a pre-film plate disposed in the primary-combustion-stage channel, and the pre-film plate is radially divided into an outer-layer pre-film plate and an inner-layer pre-film plate;

wherein the positions and injection directions of fuel jet points of the primary combustion stage are configured to control fuel of the primary combustion stage to be injected into the primary-combustion-stage channel through primary-combustion-stage fuel jet orifices, a part of the fuel directly forms primary-combustion-stage direct-injection fuel spray, and an other part of the fuel is hit on the pre-film plate close to an inner side of the primary-combustion-stage channel, or the two parts are respectively hit on the two layers of pre-film plates; and wherein the primary combustion stage includes a primary-combustion-stage fuel collection ring which is provided with multiple rows of circumferentially and uniformly distributed fuel jet points in the axial direction of the head, with some rows of the fuel jet points being aligned with the inner-layer pre-film plate, and the other rows of the fuel jet points being aligned with the outer-layer pre-film plate.

9. A low-pollution combustion control method for a combustor, the method comprising:

providing a combustor head having a primary combustion stage and a precombustion stage, the primary combustion stage and the precombustion stage being concentrically arranged;

providing, in a primary-combustion-stage channel, an inner-layer pre-film plate and an outer-layer pre-film plate which are distributed in a radial direction;

injecting primary-combustion-stage fuel out through primary-combustion-stage fuel jet orifices, wherein under small operating conditions, the primary-combustion-stage fuel has a small penetration depth and is mainly hit on the inner-layer pre-film plate of the primary-combustion-stage channel, or under large operating conditions, the primary-combustion-stage fuel is respectively hit on the inner-layer pre-film plate and the outer-layer pre-film plate of the primary-combustion-stage channel, and the fuel is hit on the pre-film plates to form liquid films; and further providing a primary-combustion-stage swirling flow, breaking and atomizing the liquid films under a shearing action of the swirling flow to form small-particle fuel spray, and mixing the fuel spray with air such that a uniformly distributed fuel-air mixture, with the center of concentration gradually moving outward from small to large, is formed in a radial direction of a primary-combustion-stage outlet and then enters a flame tube for premixed combustion;

wherein the primary-combustion-stage fuel accounts for 50% to 92% of the total quantity of fuel, and the volume of air in the combustor head accounts for 60% to 90% of the total volume of air in the combustor, with the volume of air at the primary combustion stage accounting for 60% to 90% of the volume of air in the combustor head, and the volume of air at the precombustion stage accounting for 10% to 40% of the volume of air in the combustor head.

* * * * *